US011632631B2

(12) United States Patent
Daveau et al.

(10) Patent No.: US 11,632,631 B2
(45) Date of Patent: Apr. 18, 2023

(54) LOUDSPEAKER COMPRISING A RIGID MEMBRANE CONNECTED TO AT LEAST TWO COILS

(71) Applicant: DEVIALET, Paris (FR)

(72) Inventors: Gaël Daveau, Laville-Aux-Dames (FR); Louis Jaillet, Paris (FR); Loïc Kremer, Charenton le Pont (FR)

(73) Assignee: DEVIALET, Paris (FR)

( * ) Notice: Subject to any disclaimer, the term of this patent is extended or adjusted under 35 U.S.C. 154(b) by 0 days.

(21) Appl. No.: 17/192,413

(22) Filed: Mar. 4, 2021

(65) Prior Publication Data

US 2021/0281953 A1 Sep. 9, 2021

(30) Foreign Application Priority Data

Mar. 6, 2020 (FR) ..... 20 02271

(51) Int. Cl.

| | |
|---|---|
| ***H04R 9/06*** | (2006.01) |
| ***H04R 7/02*** | (2006.01) |
| ***H04R 9/02*** | (2006.01) |
| ***H04R 9/04*** | (2006.01) |

(52) U.S. Cl.

CPC ..... *H04R 9/06* (2013.01); *H04R 7/02* (2013.01); *H04R 9/025* (2013.01); *H04R 9/045* (2013.01)

(58) Field of Classification Search

CPC . H04R 9/06; H04R 7/02; H04R 9/025; H04R 9/045

USPC ..... 381/117

See application file for complete search history.

(56) References Cited

U.S. PATENT DOCUMENTS

| | | | |
|---|---|---|---|
| 2,699,472 | A | 1/1955 | Olsen et al. |
| 4,256,930 | A | 3/1981 | Garner et al. |
| 4,438,297 | A | 3/1984 | Kawamura |
| 8,385,581 | B2 | 2/2013 | Li et al. |
| 8,831,270 | B1 | 9/2014 | Dimitrov |
| 2009/0279729 | A1 | 11/2009 | Huang |
| 2011/0170736 | A1 | 7/2011 | Li et al. |
| 2014/0286524 | A1 | 9/2014 | Robineau |

OTHER PUBLICATIONS

Preliminary Report on Patentability for FR 2002271 dated Oct. 30, 2020.

Dimitar Dimitrov, "Single Permanent Magnet Co-Axial Loudspeakers", (May 4, 2013), pp. 1-6, Audio Engineering Society Convention Paper 8847, AEs 134$^{th}$ Convention, Rome IT.

*Primary Examiner* — Sean H Nguyen

(74) *Attorney, Agent, or Firm* — B. Aaron Schulman, Esq.; Stites & Harbison, PLLC

(57) ABSTRACT

A loudspeaker (10) comprising a magnetic circuit (12), and a mobile assembly (14) along an axis (D) comprising:

Figure 1:
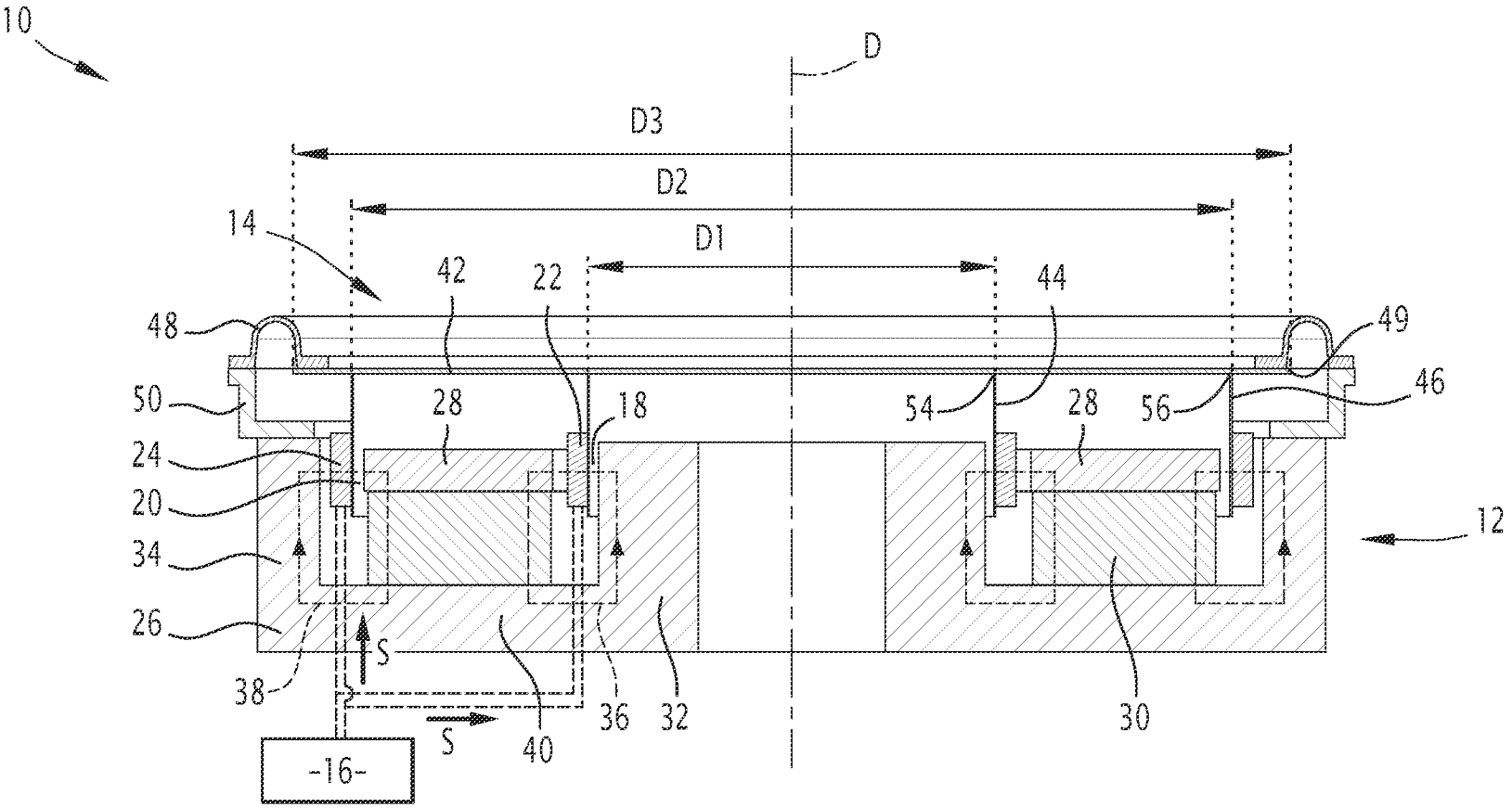

a rigid membrane (42) defining an external diameter (D3), a first reel holder (44) and a second reel holder (46), at least a first coil (22) and a second coil (24) located in a first air gap (18) and a second air gap (20) of the magnetic circuit respectively.

The first coil holder and the second coil holder form a first junction (54) and a second junction (56) with the membrane, concentric and defining a first diameter (D1) and a second diameter (D2) greater than the first.

The second diameter is:

less than 97% of the external diameter, or greater than or equal to 97% of the external diameter, the first diameter being greater than 40% of the external diameter.

10 Claims, 5 Drawing Sheets

LOUDSPEAKER COMPRISING A RIGID MEMBRANE CONNECTED TO AT LEAST TWO COILS

BACKGROUND OF THE INVENTION

Field of the Invention

The present invention relates to a loudspeaker comprising a magnetic circuit and an assembly, movable relative to the magnetic circuit along an axis of the loudspeaker, the movable assembly comprising a rigid membrane adapted to emit sound waves, and a coil set on a coil holder attached to the membrane. The coil is located in an air gap defined by the magnetic circuit. When the coil is traversed by an electric current that excites, it vibrates axially in the air gap, the vibrations thus created being transmitted to the membrane via the coil holder.

Description of Related Art

Such a loudspeaker is generally satisfactory, but sometimes the membrane does not vibrate uniformly. Indeed, at least for some excitation frequencies contained in an audio signal, it happens that the membrane has at least one area emitting waves at a higher or lower sound level than another area of the membrane. This creates distortion in the sound emitted by the membrane.

An object of the invention is therefore to provide a loudspeaker that eliminates or reduces these distortions in the sound emitted by the membrane.

BRIEF SUMMARY OF THE INVENTION

For this purpose, the object of the invention is a loudspeaker comprising a magnetic circuit and an assembly, movable relative to the magnetic circuit along an axis of the loudspeaker, the movable assembly comprising:

- a rigid membrane adapted to emit sound waves and defining an external diameter,
- at least a first coil holder and a second coil holder attached to the rigid membrane,
- at least a first coil and a second coil attached to the first coil holder and the second coil holder respectively and located in a first air gap and a second air gap respectively defined by the magnetic circuit, the first coil holder and the second coil holder forming a first junction and a second junction respectively with the rigid membrane, the first junction and the second junction being concentric with respect to the axis and defining a first junction diameter and a second junction diameter respectively, larger than the first junction diameter, the second junction diameter being:

- less than 97% of the external diameter, or
- greater than or equal to 97% of the external diameter, the first junction diameter then being greater than 40% of the external diameter.

According to particular embodiments, the loudspeaker includes one or more of the following characteristics, taken alone or according to all technically possible combinations:

- the rigid membrane is flat, or forms a portion of a sphere or cone;
- the rigid membrane defines an opening centered on the axis and extending radially below the first junction;
- the first and second coil holders have a general shape of revolution around the axis;

- the loudspeaker comprises a single excitation source connected electrically to the first coil and the second coil;
- the first coil and the second coil are connected electrically in parallel to the excitation source;
- the first coil and the second coil are connected electrically in series to the excitation source;
- the loudspeaker comprises at least a first excitation source and a second excitation source, separate from each other, and configured to send a first electrical signal and a second electrical signal to the first coil and the second coil respectively;
- the first electrical signal and the second electrical signal respectively have frequency components having a predetermined phase shift between them; and
- the magnetic circuit comprises a permanent magnet located radially with respect to the axis between the first air gap and the second air gap.

BRIEF DESCRIPTION OF THE SEVERAL VIEWS OF THE DRAWING(S)

Figure 2:
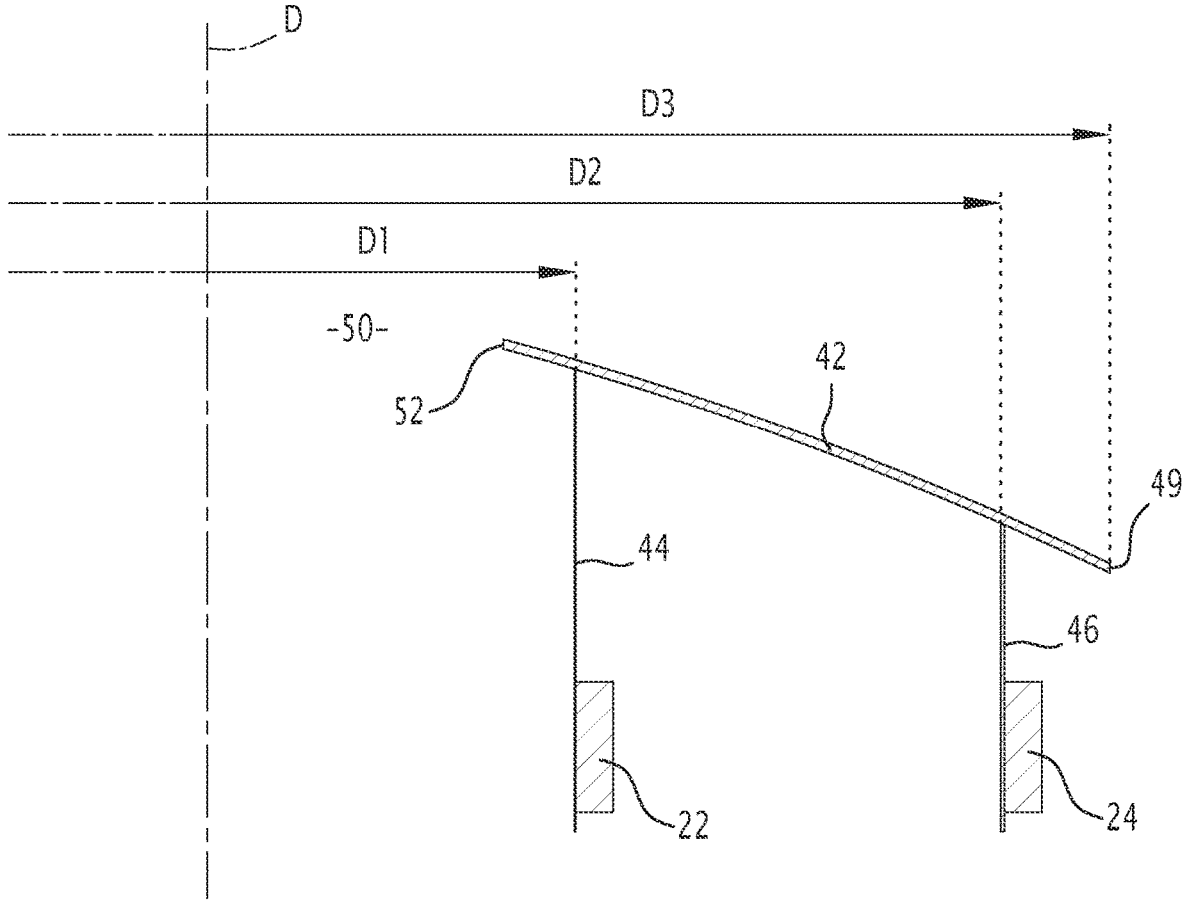
Figure 3:
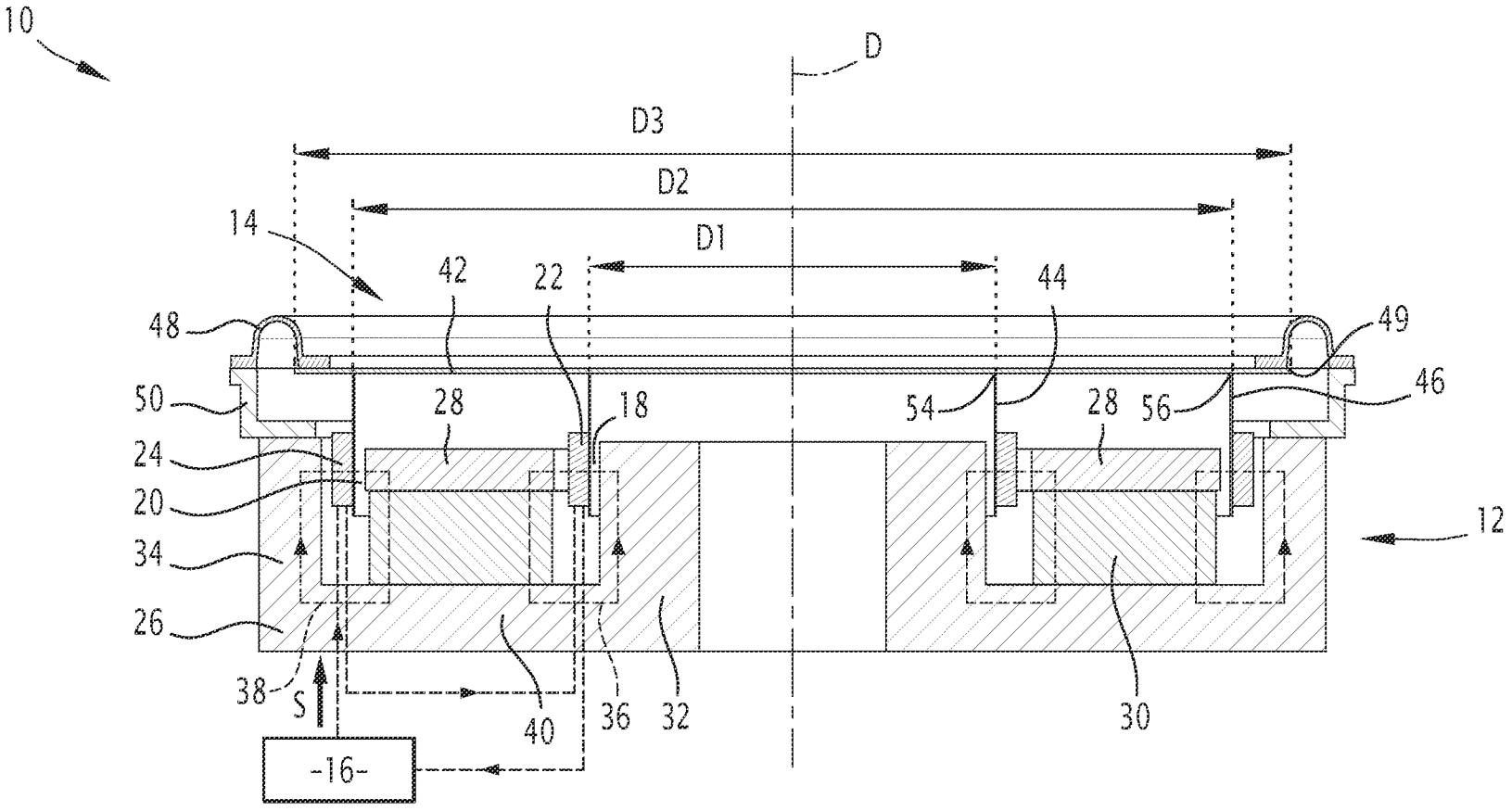
Figure 4:
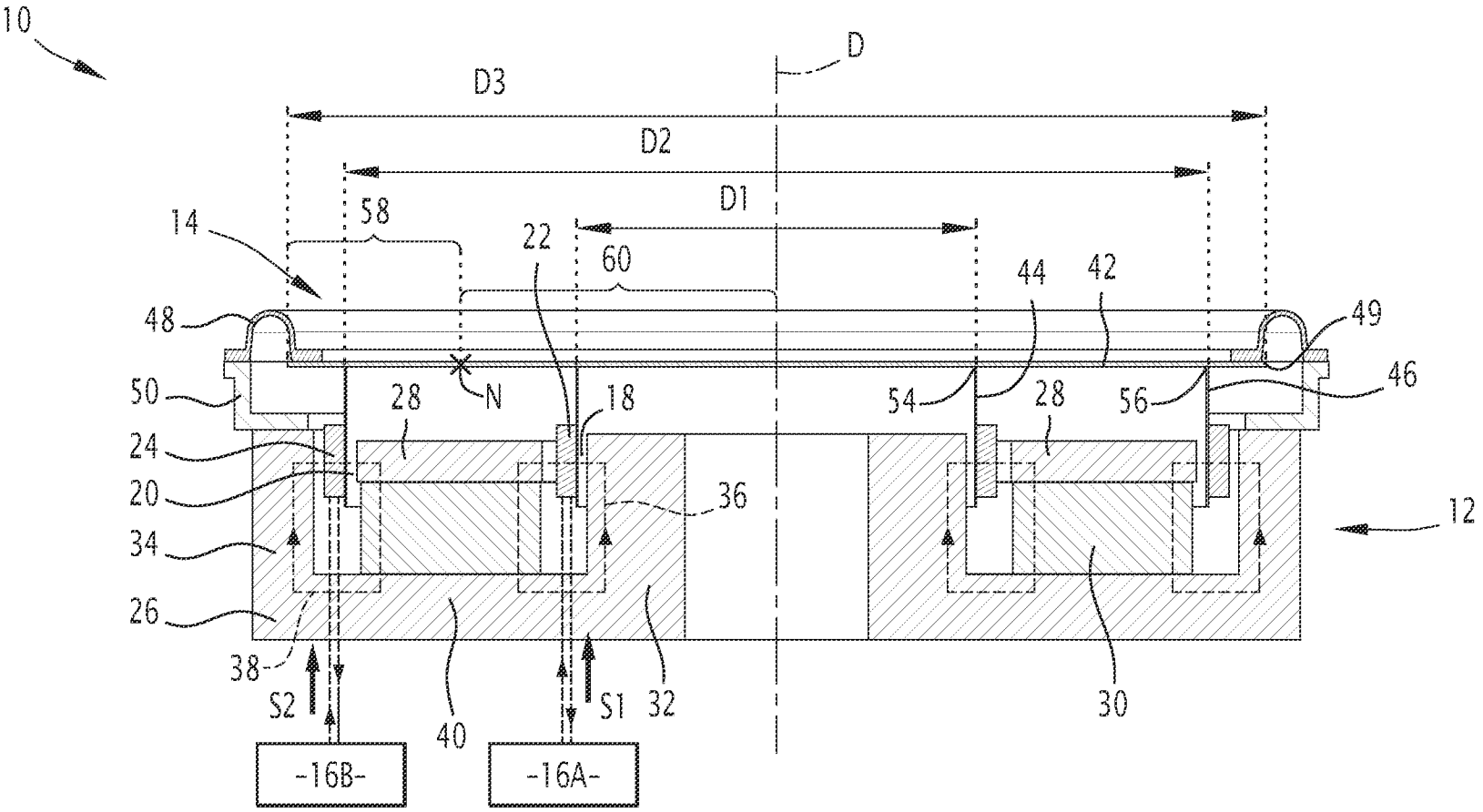
Figure 5:
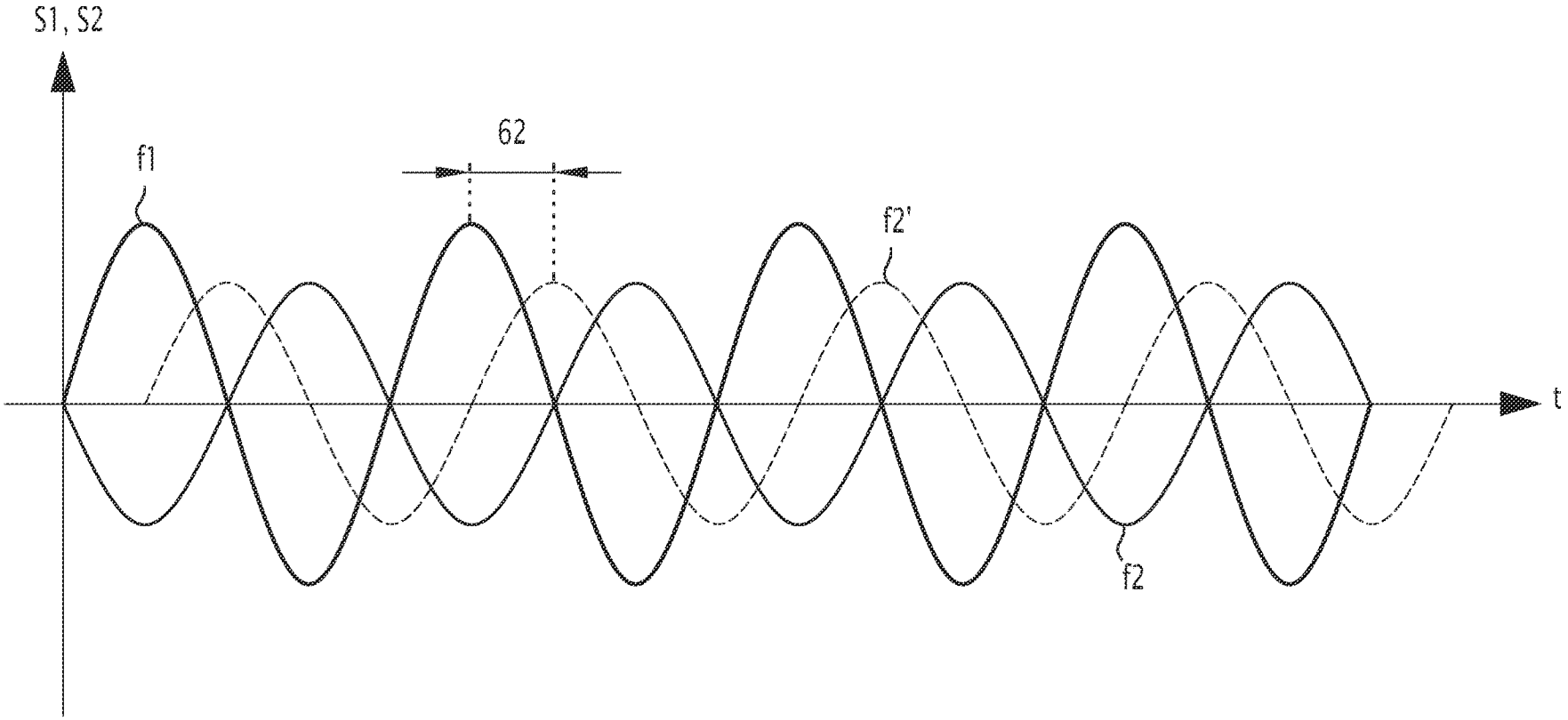

The invention will be better understood upon reading the description that follows, given only as an example and made with reference to the appended drawings, in which:

FIG. 1 is a schematic view of a loudspeaker according to the invention, sectional along a radial plane passing through the axis of the loudspeaker, FIG. 2 is a partial sectional view of a first variant of the loudspeaker shown in FIG. 1, FIG. 3 is a view similar to FIG. 1 and shows a second variant of the loudspeaker shown in FIG. 1, FIG. 4 is a view similar to FIGS. 1 and 3, and shows a third variant of the loudspeaker shown in FIG. 1, and FIG. 5 is a diagram schematically showing the frequency components of signals sent by the excitation sources of the loudspeaker shown in FIG. 4.

DETAILED DESCRIPTION OF THE INVENTION

With reference to FIG. 1, a loudspeaker 10 is described according to the invention. The loudspeaker 10 comprises a magnetic circuit 12 and a movable assembly 14, movable in translation along an axis D of the loudspeaker around a balanced position (shown in FIG. 1). In the example shown, the loudspeaker 10 comprises a single excitation source 16 connected electrically to the movable assembly 14.

The magnetic circuit 12 axially defines a rear side of the speaker 10 with respect to the movable assembly 14.

In the example shown, the magnetic circuit 12 defines a first air gap 18 and a second air gap 20 receiving a first coil 22 and a second coil 24 respectively from the movable assembly 14.

In variants not shown, the magnetic circuit 12 defines more than two air gaps, three for example, and each of these air gaps receives a coil from the movable assembly 14.

In the example shown, the magnetic circuit 12 has a general shape to revolve around the D axis.

The first air gap 18 and the second air gap 20 are annular and concentric, for example.

The magnetic circuit 12 includes a the magnetic guide 26, a ring 28, and a magnet 30 for example, advantageously permanent.

As can be seen in FIG. 1, the magnetic guide 26 has a "U" shape around the D-axis, for example. The "U" opens axially to the front.

The magnetic circuit 26 has a radially inner leg 32 which, together with the ring 28, defines the first air gap 18. The magnetic guide 26 has a radially external leg 34 which, together with the ring 28, defines the second air gap 20.

The magnetic guide 26 and the ring 28 are made of a metallic material adapted to conduct magnetic field lines 36, 38 created by the magnet 30 and forming loops in the magnetic circuit 12.

In the example shown, the magnetic guide 26 forms a frame of the loudspeaker 10.

The magnet 30 is of a type known per se to the person skilled in the art. Advantageously, the magnet 30 is located axially between the ring 28 and a base 40 of the "U" formed by the magnetic guide 26.

Advantageously, the magnet 30 is located radially between the first air gap 18 and the second air gap 20. In other words, the magnet 30 has a radial extension less than or equal to that of the ring 28, with the magnet extending radially neither beyond nor below the ring 28. This simplifies the magnetic circuit 12.

The magnet 30 is adapted to generate the magnetic field lines 36 (only one of which is shown in FIG. 1) that pass through part of the ring 28, the first air gap 18, the leg 32 of the magnetic guide 26, and part of the base 40 of the magnetic guide. The magnet 30 is also adapted to generate magnetic field lines 38 (only one of which is shown in FIG. 1) that pass through another part of the ring 28, the second air gap 20, the leg 34 of the magnetic guide 26, and another part of the base 40.

In variants not shown, the magnetic circuit 12 has a different arrangement from that shown in FIGS. 1, 3 and 4. For example, the magnet 30 is located at a different location on the magnetic circuit 12. In another example, the magnetic circuit 12 has several magnets.

As seen in FIG. 1, in addition to the first coil 22 and the second coil 24, the movable assembly 14 comprises a rigid membrane 42, a first coil holder 44 to which the first coil 22 is attached, and a second coil holder 46 to which the second coil 24 is attached.

The membrane 42 is connected by a flexible joint 48 to a part 50 attached to the magnetic circuit 12.

The membrane 42 is for example made of metal, metal alloy, made of unfilled or advantageously filled injected plastic, graphene, paper, or any carbon fiber or glass fiber-based material.

The rigid membrane 42 advantageously has a Young's module greater than 1 GPa (Gigapascal). For example, the rigid membrane 42 has a thickness of between 0.02 and 5 mm.

The rigid membrane 42 has a radially external edge 49 defining an external diameter D3.

In the example shown in FIG. 1, the rigid membrane 42 is flat. Also, in this example, the rigid membrane 42 forms a disc perpendicular to the axis D.

According to a variant shown in FIG. 2, the membrane 42 is not flat, but forms a portion of a sphere centered on the D axis. In addition, the rigid membrane 42 shown in FIG. 2 defines, for example, an opening 50 centered on the D axis.

In FIG. 2, the opening 50 is delimited by a radially inner edge 52 of the rigid membrane 42, the edge being circular, for example.

In another variant not shown, the rigid membrane 42 forms a cone or part of a cone, such as a truncated cone.

In still other variants, the rigid membrane 42 advantageously is convex, with a forward-facing convexity. For example, the membrane 42 forms a spherical cap.

In still other variants, the rigid membrane 42 is concave, with a forward-facing concavity.

The first coil holder 44 and the second coil holder 46 are shown schematically as simple cylinders in the Figures. In reality, the first coil holder 44 and the second coil holder 46 may have more complex shapes, such as a lattice shape.

The first coil holder 44 and the second coil holder 46 form a first junction 54 and a second junction 56 respectively with the rigid membrane 42.

The first junction 54 and the second junction 56 are concentric with respect to the D axis and define a first junction diameter D1, and a second junction diameter D2 respectively larger than the first junction diameter D1.

In case of ambiguity in defining the junction diameter, the radially external face of the junction is considered as defining the junction diameter.

In the example shown in FIG. 1, the second junction diameter D2 is less than 97% of the external diameter D3.

The first junction diameter D1 then takes any value, in mm, greater than or equal to 0, and less than the second junction diameter D2.

According to a variant not shown, the second junction diameter D2 is greater than or equal to 97% of the external diameter D3, that is, the second junction 56 is radially very close to the edge 49 of the membrane 42. In this case, the first junction diameter D1 is greater than 40% of the external diameter D3.

Advantageously, the first junction diameter D1 is between 60% and 95% of the second junction diameter D2, preferably between 85% and 95%.

Advantageously, the second joint diameter D2 is between 55% and 100% of the external diameter D3, preferably between 75% and 100%.

In FIG. 1, the excitation source 16 is electrically connected to the first coil 22 and the second coil 24, which are connected in parallel with each other.

This configuration in parallel makes it possible, for the assembly consisting of the first coil 22 and the second coil 24, to obtain a moderate overall electrical impedance (comparable to a resistance in the case of very low frequencies) for a moderate overall force factor (proportional to the overall force imposed on the rigid membrane 42). In fact:

The global impedance is:

$$Z=(Z1\times Z2)/(Z1+Z2)$$

and the overall force factor is:

$$B=(B1\times Z2-B2\times Z1)/(Z1+Z2)$$

With:

Z1 impedance of the first coil 22,

Z2 impedance of the second coil 24,

B1 force factor of the first coil 22, and

B2 force factor of the second coil 24.

In this case, the excitation source 16 is adapted to send the same signal S to the first coil 22 and the second coil 24.

According to a variant shown in FIG. 3, the first coil 22 and the second coil 24 are electrically connected in series to the excitation source 16.

Compared to the configuration in parallel, this configuration has the advantage of obtaining a very high overall force factor at the expense of a high overall electrical impedance.

Indeed, in this configuration in series:

$$Z=Z1+Z2, \text{ and}$$

$$B=B1+B2$$

In a variant shown in FIG. 4, the loudspeaker 10 comprises a first excitation source 16A configured to send a first electrical signal S1 to the first coil 22, and a second excitation source 16B, separate from the first excitation source 16A, configured to send a second electrical signal S2 to the second coil 24.

Advantageously, this enables modulation of the mechanical stresses transmitted to the rigid membrane 42 by the first coil holder 44 and the second coil holder 46 at the first junction 54 and the second junction 56.

For example, if the rigid membrane 42 has a node N (FIG. 4) at a resonant frequency, the node N being located radially between the first junction 54 and the second junction 56, it becomes possible to differently stress a part 58 of the rigid membrane 42 radially external with respect to the node N, and a part 60 radially internal with respect to the node N.

Advantageously, the first electrical signal S1 and the second electrical signal S2 respectively, at least for a given duration, comprise frequency components with a predetermined phase shift between them. For example, these frequency components are in phase (0° phase shift), or, on the contrary, in phase opposition (180° phase shift).

According to a particular embodiment, the phase shift has another value of between 0° and 360°.

This is shown in FIG. 5. For example, the first signal S1 includes a frequency component f1 and the second signal S2 includes a frequency component f2 that has the same frequency but is in phase opposition with the frequency component f1.

In another example, the second signal S2 includes a frequency component f2' that has the same frequency as the frequency component f1 but has a predetermined phase shift 62.

Advantageously, the phase shift applied relates only to certain frequencies, for example a range of frequencies including a resonance frequency of the rigid membrane 42.

According to a particular embodiment, the phase shift applied to a frequency component depends on the frequency.

It is thus possible to increase the overall sound level of the rigid membrane 42 by bringing the movement of the two parts 58, 60 closer to movement in phase by sending two signals of advantageously proportioned amplitude to these parts, in phase with each other.

It also becomes possible to lower the sound level by slowing down the movement of one of the parts 58, 60 by sending this part an amplitude stress advantageously proportioned and out of phase with its natural movement.

Thanks to the features described above, in particular the presence of two coil holders whose junctions with the rigid membrane have the diameters defined above, the loudspeaker 10 has reduced sound distortion.

Indeed, even if the rigid membrane has its own modes of resonance corresponding to certain frequencies that are detrimental to the acoustic quality of the loudspeaker, the fact of transmitting the mechanical stress to the membrane through these two junctions makes it possible to limit the effects of resonance by pushing the frequencies of appearance of these resonance modes towards the high frequencies. These modes will thus be less likely to be excited by the loudspeakers operation.

Moreover, if the loudspeaker optionally includes at least two distinct excitation sources connected to the first and second coils respectively, this "passive" stabilizing effect is coupled with an "active" stabilizing effect consisting in modulating the first electrical signal S1 and the second electrical signal S2 so as to limit, or, on the contrary, to increase the sound level emitted by parts 58, 60 of the membrane.

The invention claimed is:

1. A loudspeaker comprising a magnetic circuit and a movable assembly relative to the magnetic circuit along an axis of the loudspeaker, the movable assembly comprising:

a rigid membrane adapted to emit sound waves and defining an external diameter, wherein the rigid membrane has a Young's modulus greater than 1 GPa, at least a first coil holder and a second coil holder attached to the rigid membrane, and at least a first coil and a second coil attached to the first coil holder and the second coil holder respectively and located respectively in a first air gap and a second air gap defined by the magnetic circuit, wherein the first coil holder and the second coil holder form a first junction and a second junction respectively with the rigid membrane, the first junction and the second junction being concentric with respect to the axis and respectively defining a first junction diameter and a second junction diameter greater than the first junction diameter, and wherein the second junction diameter is less than 97% of the external diameter.

2. The loudspeaker according to claim 1, wherein the rigid membrane defines an opening centered on the axis and extending radially below the first junction.

3. The loudspeaker according to claim 1, wherein the first coil holder and the second coil holder have a general shape of revolution around the axis.

4. The loudspeaker according to claim 1, comprising a same excitation source electrically connected to the first coil and the second coil.

5. The loudspeaker according to claim 4, wherein the first coil and the second coil are electrically connected in parallel to the excitation source.

6. The loudspeaker according to claim 4, wherein the first coil and the second coil are electrically connected in series to the excitation source.

7. The loudspeaker according to claim 1, comprising at least a first excitation source and a second excitation source separate from each other, and configured to send a first electrical signal and a second electrical signal respectively to the first coil and the second coil.

8. The loudspeaker according to claim 7, wherein the first electrical signal and the second electrical signal respectively comprise frequency components that have a predetermined phase shift between them.

9. The loudspeaker according to claim 1, wherein the magnetic circuit comprises a permanent magnet located radially with respect to the axis between the first air gap and the second air gap.

10. A loudspeaker comprising a magnetic circuit and a movable assembly relative to the magnetic circuit along an axis of the loudspeaker, the movable assembly comprising:

a rigid membrane adapted to emit sound waves and defining an external diameter, at least a first coil holder and a second coil holder attached to the rigid membrane, at least a first coil and a second coil attached to the first coil holder and the second coil holder respectively and located respectively in a first air gap and a second air gap defined by the magnetic circuit, wherein the first coil holder and the second coil holder form a first junction and a second junction respectively with the rigid membrane, the first junction and the second junction being concentric with respect to the axis and respectively defining a first junction diameter and a second junction diameter greater than the first junction diameter, the second junction diameter being greater than or equal to 97% of the external diameter, the first junction diameter then being greater than 40% of the external diameter.

* * * * *